US005931015A

United States Patent [19]

Maeda

[11] Patent Number: 5,931,015

[45] Date of Patent: Aug. 3, 1999

[54] DESICCANT ASSISTED AIR CONDITIONING SYSTEM

[75] Inventor: Kensaku Maeda, Fujisawa, Japan

[73] Assignee: Ebara Corporation, Tokyo, Japan

[21] Appl. No.: 08/877,407

[22] Filed: Jun. 18, 1997

[30] Foreign Application Priority Data

Jun. 20, 1996 [JP] Japan ..... 8-179943

[51] Int. Cl.[6] ..... F25D 17/06

[52] U.S. Cl. ..... 62/271; 96/123

[58] Field of Search ..... 62/94, 271; 55/351; 95/107; 96/121, 123

[56] References Cited

U.S. PATENT DOCUMENTS

| | | | |
|---|---|---|---|
| 3,488,971 | 1/1970 | Meckler | 62/271 |
| 4,180,985 | 1/1980 | Northrup, Jr. | 62/271 |
| 4,207,084 | 6/1980 | Gardner | 96/123 |
| 4,430,864 | 2/1984 | Mathiprakasam | 62/94 |
| 4,474,021 | 10/1984 | Harband | 62/271 |
| 4,574,874 | 3/1986 | Duran | 96/123 |
| 4,887,438 | 12/1989 | Meckler | 62/271 |
| 5,212,956 | 5/1993 | Tsimerman | 62/271 |
| 5,325,676 | 7/1994 | Meckler | 62/93 |
| 5,448,895 | 9/1995 | Coellner et al. | 62/94 |
| 5,509,275 | 4/1996 | Bhatti et al. | 62/271 |

*Primary Examiner*—William E. Tapolcai
*Attorney, Agent, or Firm*—Armstrong, Westerman, Hattori, McLeland & Naughton

[57] ABSTRACT

A high efficiency air conditioning system is proposed, in which, while operating on a batch system, desiccant regeneration and process air dehumidification can be carried out simultaneously with a simple configuration. The air conditioning system comprises at least two desiccant members, a process air passage for providing a process air to one of the desiccant members for dehumidification of the process air, and a regeneration air passage for providing a regeneration air to the other of the desiccant members for regeneration of the regeneration air. The desiccant members are movable with respect to the process air passage and the regeneration air passage to alternatingly switch each of the desiccant members from one of the regeneration air passage and the process air passage to another.

10 Claims, 7 Drawing Sheets

DESICCANT ASSISTED AIR CONDITIONING SYSTEM

BACKGROUND OF THE INVENTION

1. Field of the Invention

The present invention relates in general to air conditioners, and relates in particular to an air conditioning system having a continuous air processing capability by alternately treating the process air through at least two desiccant members.

2. Description of the Related Art

FIG. 6 shows a prior art example of desiccant assisted air conditioning system same as the system disclosed in a U.S. Pat. No. 4,430,864. The system comprises: a process air passage A; a regeneration air passage B; two desiccant beds 103A, 103B; and a heat pump device 200 for desiccant regeneration and cooling of process air. The heat pump device 200 utilizes heat exchangers, embedded in the two desiccant beds 103A and 103B, as high and low temperature heat sources. In each of the thermal medium passages, there are opposingly disposed expansion valves 240A, 240B and one-way valves 241A, 241B, which are arranged parallel to the expansion valves 240A, 240B respectively, and the direction of compression of the compressor 230 can be switched by a four-way valve 250.

In the technology described above, cooling and dehumidifying processes can be explained with reference to a psychrometric chart shown in FIG. 7. The process air (state K) is withdrawn by a blower 102 through a passage 110, raised in pressure, and is forwarded to the one desiccant bed 103A through the passage 111 and the four-way valve 105 and passage 112A, where the moisture in the process air is adsorbed, to lower its humidity ratio and raise its temperature by the effect of the heat of adsorption. Because the desiccant bed 103A is cooled by the heat pump 200 through the heat exchanger 220, the adsorption heat is absorbed and the temperature of the process air does not rise too much, and after saturating (state L), the process air is dehumidified along iso-relative humidity line. The process air which has been dehumidified and maintained at the temperature (state N) is supplied to the conditioning space through the passage 113A, the four-way valve 106, passage 114. An enthalpy difference ΔQ is thus produced between the return air from the conditioning space (state K) and the cooled process air (state N), to provide cooling of the conditioning space.

The regeneration process of the desiccant is performed as follows. Regeneration air (state Q) is withdrawn into the blower 140 through the passage 120, raised in pressure, and is forwarded to the other desiccant bed 103B through the passages 121, 122, the four-way valve 106, and the passage 113B. The desiccant bed 103B is heated by the heat pump 200 by way of the heat exchanger 210, so its temperature is raised, and the relative humidity is lowered (state R). The regeneration air which now has a lowered relative humidity passes through the desiccant bed 103B to remove the moisture from the desiccant material (state T). The regeneration air which has passed through the desiccant bed 103B passes through the passage 112B, four-way valve 105 and the passage 124 and is discharged to an outside environment.

After the air conditioning process has been carried out for sometime and the moisture content in the desiccant becomes higher than a certain value, the four-way valve is operated to be switched, so that the air passages for the desiccants and cooling/heating of the heat pumps are interchanged. Thus, the operation is carried on so that the regenerated desiccant is used to continue air conditioning operation while the other desiccant is being regenerated. Therefore, it can be seen that the processes of adsorption and regeneration are conducted in a batch type system.

In the technology described above, heat exchange of the low temperature heat source of the heat pump and the desiccant for adsorption are embedded into a unit, and heat exchange of the high temperature heat source of the heat pump and the desiccant on the regeneration side are embedded into a unit. So, the cooling effect ΔQ is provided by a direct thermal load on the heat pump (refrigeration device), which means that it is not possible to generate more cooling than that allowed by the capacity of the heat pump acting as a refrigeration device. Therefore, this configuration does not provide any advantages worthy of making the apparatus complex. In addition, there has been required two four-way valves, one for reversing the operation cycle of the heat pump and the other for interchanging the passages of the process/regeneration air, which further makes the configuration of the apparatus complex.

SUMMARY OF THE INVENTION

It is an object of the present invention to provide a high efficiency air conditioning system in which, while operating on a batch system, desiccant regeneration and process air dehumidification can be carried out simultaneously with a simple configuration.

The object has been achieved in a desiccant assisted air conditioning system comprising: at least two desiccant members; a process air passage for providing a process air to one of the desiccant members for dehumidification of the process air; and a regeneration air passage for providing a regeneration air to the other of the desiccant members for regeneration of the regeneration air, wherein the desiccant members are movable with respect to the process air passage and the regeneration air passage to alternatingly switch each of the desiccant members from one of the regeneration air passage and the process air passage to another.

DESCRIPTION OF THE PREFERRED EMBODIMENTS

In the following, preferred embodiments will be presented with reference to the attached drawings.

Figure 1:
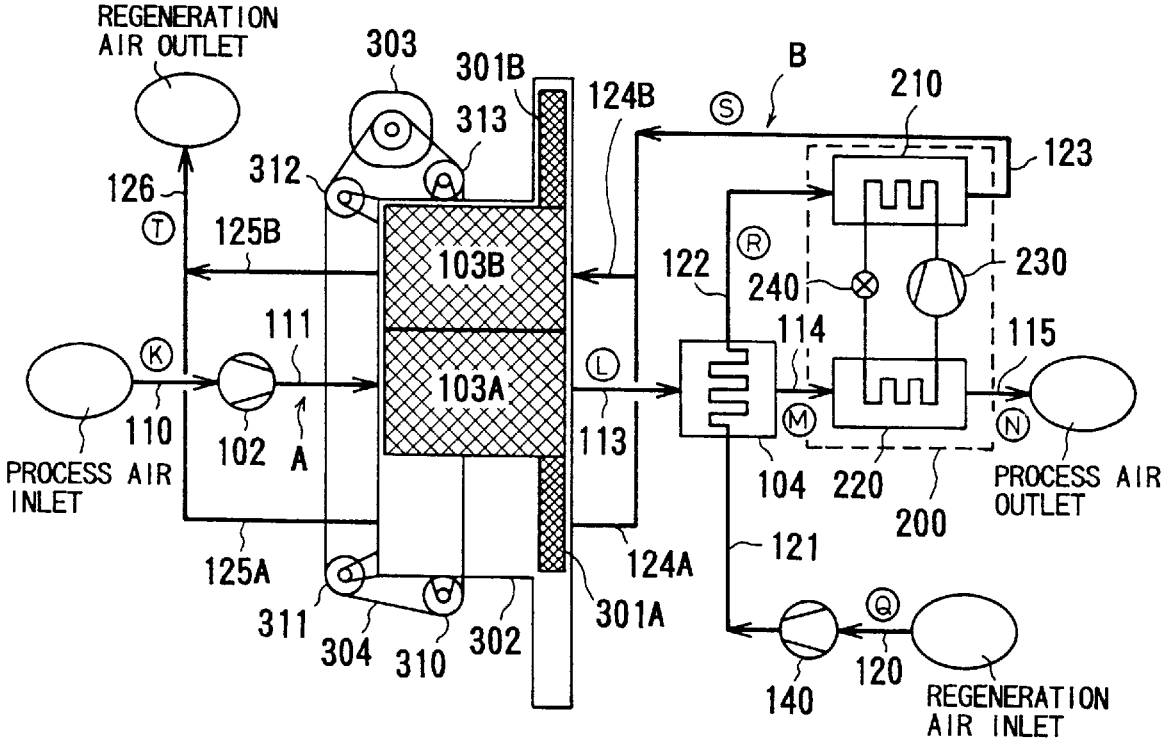
FIG. 1 is schematic representation of a first embodiment of the basic configuration of the air conditioning system of the present invention.
Figure 2:
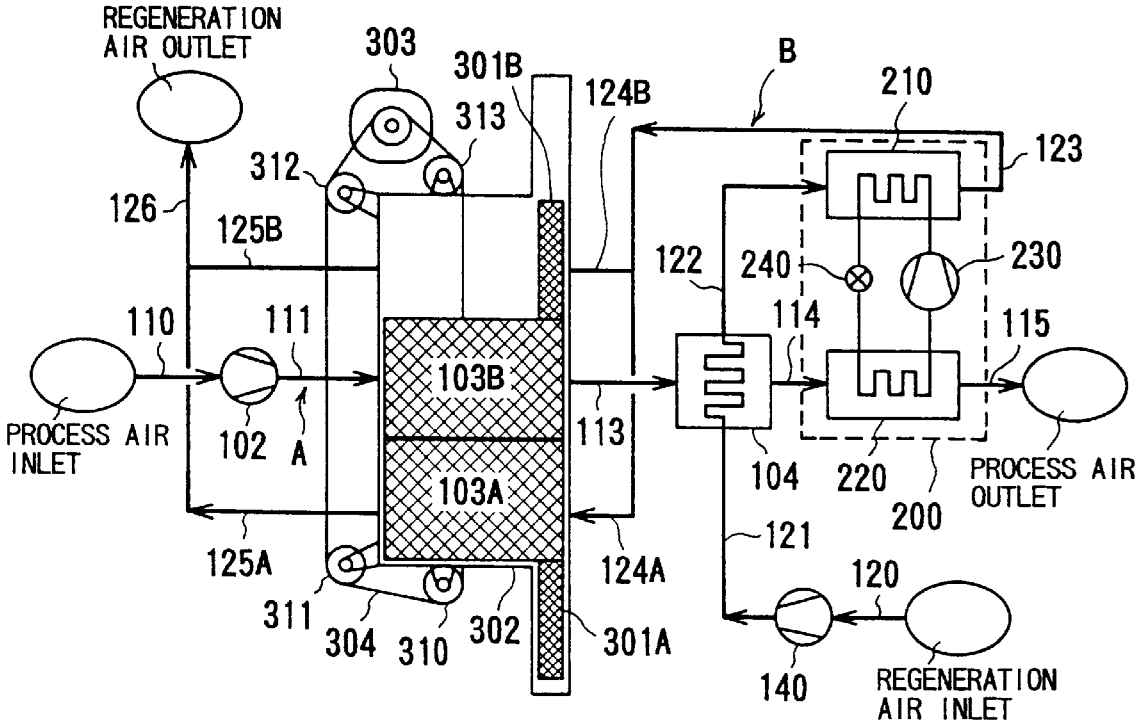
FIG. 2 is a schematic representation of a first embodiment of the other configuration of the air conditioning system of the present invention.

FIGS. 1 and 2 relate to the first embodiment of the air conditioning system, which comprises: a process air passage A; a regeneration air passage B: two desiccant beds 103A, 103B; and a heat pump device 200 for performing regeneration of the desiccant and cooling for the process air. Though any type of heat pump device can be used, in the embodiment, a vapor compressor type heat pump device disclosed in a U.S. Pat. application Filing No. 08/781,038 filed by the inventor is used.

Process air passage A starts from a process air inlet (usually an interior air intake), and reaches a process air inlet of a casing 302 which houses the desiccants beds 103A, 103B, through the blower 102 and passage 111, and further reaches a process air outlet of the casing 302 by way of one of the desiccant beds 103A, 103B. The process air outlet of the casing 302 is communicated through the passage 113 with a process air inlet of a sensible heat exchanger 104 heat-exchangeable with regeneration air, a process air outlet of the sensible heat exchanger 104 is communicated a heat exchanger 220 serving as the low temperature heat source for the heat pump device 200 through the passage 114. Then the process air passage A reaches the process air outlet through the passage 115.

Regeneration air passage B starts from a regeneration air inlet (usually an exterior air inlet), and, proceeds to the passage 120, the blower 140, the passage 121, a heat exchanger 104 heat-exchangeable with the process air, a heat exchanger 210 serving as the high temperature heat source for the heat pump device 200 and one of the passages 124A, 124A, to reach one of two regeneration air inlets of the casing 302, which can be shut and opened by shutters 301A, 301B in coordination with the desiccant beds 103A, 103B. Regeneration air passage B further proceeds to the one of the regeneration air outlets 125A, 125B of the casing 302 by way of the desiccant beds 103A, 103B to reach the regeneration air outlet through the passage 126.

The desiccant beds 103A, 103B can be moved inside the casing 302 by a motor 303 through a pulley-belt mechanism so that the desiccant beds 103A, 103B are arranged as shown in FIG. 1 when the desiccant 103A is in the absorption process and the desiccant bed 103B is in the regeneration process, or arranged as shown in FIG. 2 when the desiccant 103A is in the regeneration process and the desiccant bed 103B is in the absorption process. In an interlocking manner with the desiccant bed 103A, 103B, the shutter 301A is operated to shut the inlet connected to the passage 124A as shown in FIG. 1, or the shutter 301B to shut the inlet connected to the passage 124B as shown in FIG. 2.

Next, the operation of the first embodiment system having the heat pump device serving as the heat source, will be described with reference to a psychrometric chart shown in FIG. 3. The operation is according to the system setup shown in FIG. 1 which shows the desiccant beds 103A, 103B are positioned so that the desiccant bed 103A communicates with the process air passage A and the desiccant bed 103B communicates with the regeneration air passage B.

Process air (state K) is admitted into a process air inlet, and is withdrawn into the blower 102 through the passage 110, raised in pressure, and is forwarded, through the passage 111 and the regeneration air inlet of the casing 302, to one desiccant bed 103A where the moisture in the air is adsorbed to lower its humidity ratio, and the temperature is raised by the heat of adsorption (state L). The air which has been dehumidified and raised in temperature is supplied to the sensible heat exchanger 104 through the passage 113, and is cooled in the sensible heat exchanger 104 by heat exchange with the regeneration air (state M). The air which has been dehumidified and cooled is forwarded to the heat exchanger 220 serving as the low temperature heat source for the heat pump device 200, and after being cooled, it is finally supplied to the conditioning space through the passage 115 (state N). An enthalpy difference ΔQ thus produced between the return air (state K) and the supply air (state N) provides cooling to the conditioning space.

During the same cycle, the other desiccant 103B performs a regeneration process as follows. Regeneration air (state Q) is withdrawn into the blower 140 through the passage 120, raised in pressure, and is forwarded to the sensible heat exchanger 104 through the passage 121, and cools the process air while its own temperature is being raised (state R). The regeneration air then flows into the heat exchanger 210 acting as the high temperature heat source of the heat pump device 200 through the passage 122, and is heated by the refrigerant to about 60~80° C., and its relative humidity is lowered (state S). The regeneration air having a lowered relative humidity is introduced into the casing 302 through a regeneration air inlet thereof and then passes through the desiccant bed 103B to remove the moisture in the desiccant bed (state T). The regeneration air which has passed through the desiccant bed 103B reaches the regeneration air outlet through the passage 125B and the passage 126. Since the regeneration air inlet connected to the passage 124A is shut by the shutter interlockingly with the desiccant beds 103A, 103B, the regeneration air does not pass through the passage 124A.

When the water content of the desiccant bed exceeds a predetermined level after a certain period of air conditioning operation, the desiccant beds 103A, 103B are moved by the motor 303 through the pulley-belt mechanism so that the desiccant 103A communicates with the regeneration air passage B and the desiccant bed 103B communicates with the process air passage A. FIG. 2 shows the air conditioning system in which the desiccant bed 103A, 103B are moved relatively to the casing 302 so that the desiccant 103A communicates with the regeneration air passage B and the desiccant bed 103B communicates with the process air passage A. The regeneration air passes through the passage 124B and the passage 125 B is shut. The detailed description of the operation thereof is omitted since the action of the apparatus is similar to that shown in FIG. 1.

As described above, the system is operated by repeating the process of alternating cycles of dehumidification and cooling of each desiccant bed 103A, 103B. Incidentally, it has long been a wide practice to recycle the return room air as regeneration air, and in this invention, this approach may also be used to achieve the same end results. Further, since the system described above does not require the four-way valve for reversing the operation cycle of the heat pump and for interchanging the passages of the process/regeneration air, the apparatus can be made simple.

Figure 3:
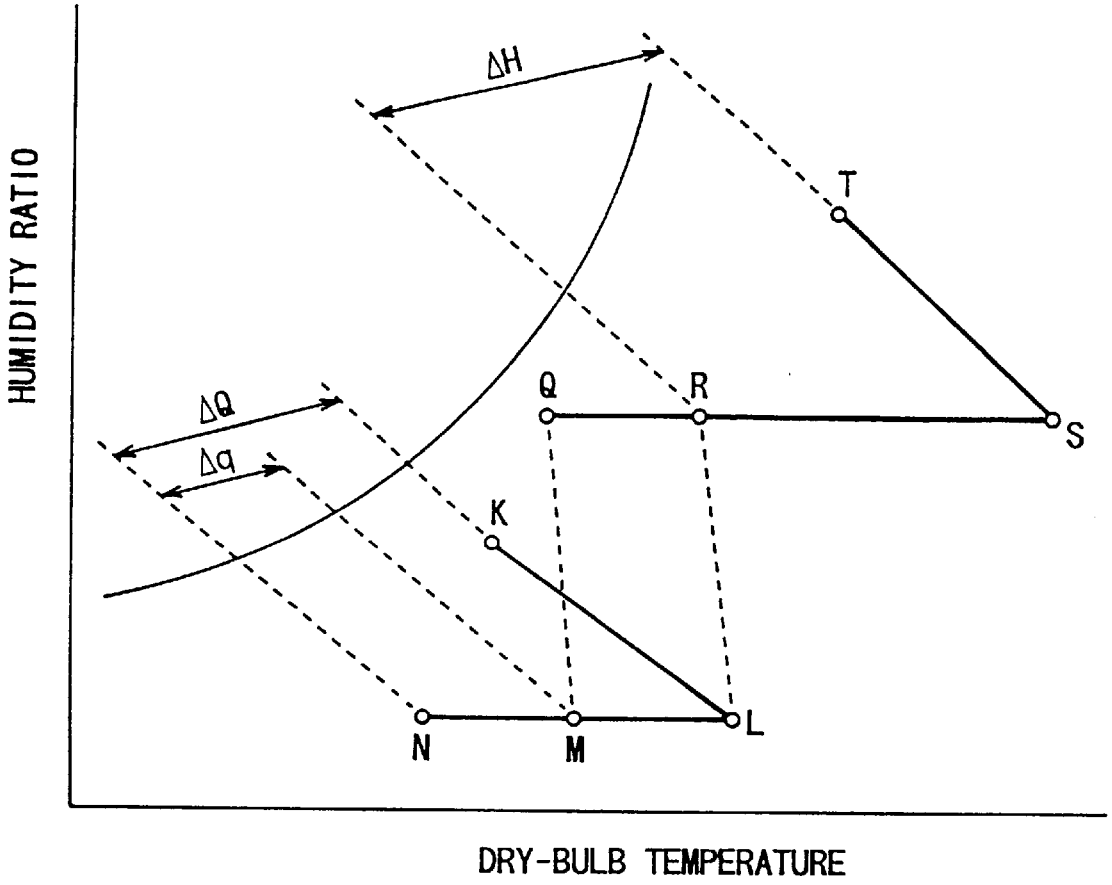
FIG. 3 is a psychrometric chart of the air conditioning cycle in the first embodiment.

In the present air conditioning system, the cooling effect produced by the heat pump device is represented by Δq, a differential enthalpy between the state M and state N shown in FIG. 3, which is significantly less than the cooling capacity for the entire system, ΔQ. In other words, the system can generate a cooling effect which surpasses the capacity of the heat pump device, thus enabling to produce a compact unit and lower the manufacturing cost.

Figure 4:
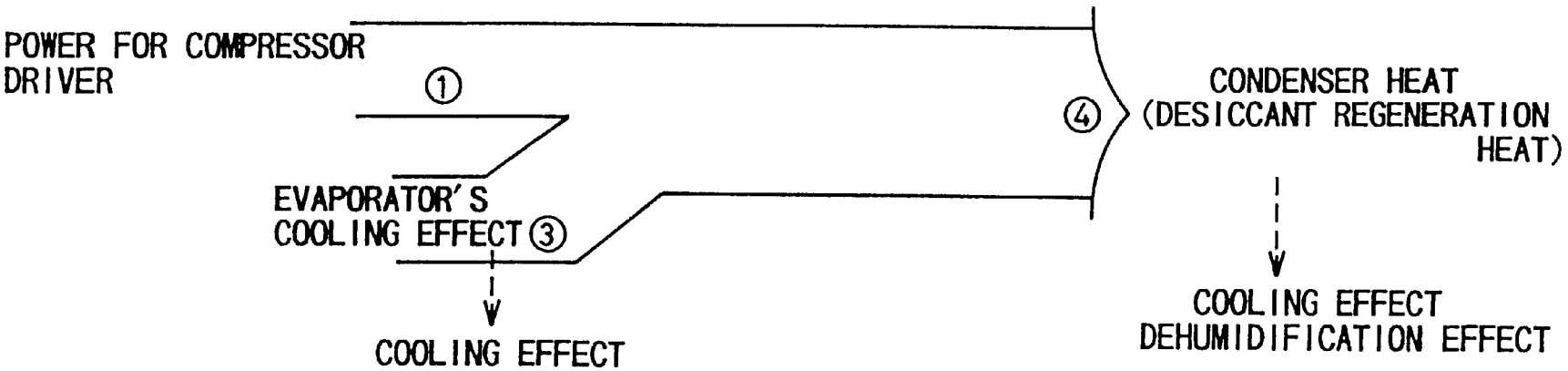
FIG. 4 is an illustration of the movement of heat in the present air conditioning system.

The thermal flow in the heat pump device of the present system is illustrated in FIG. 4. The heat input, represented by a sum of the heat introduced from the low temperature heat source of the heat pump and the power for the compressor, is given to heat the regeneration air. The temperature lift of this type of heat pump device can be estimated to be at least 55° C., in extracting heat from evaporator at 15° C. and raising it to 70° C., which is 22% higher than a typically achievable temperature lift of 45° C. in conventional heat pump devices, and the pressure ratio is also somewhat higher than the conventional heat pump devices. Therefore, when designating the heat output from the compressor as one heat unit, the coefficient of performance (COP) can be designed up to a value of 3 units. It follows that the input heat from the evaporator is 3, and the output heat is a total of 1+3=4, and all of this heat output is available to heat the regeneration air for use in the desiccant assisted air conditioning system.

Figure 6:
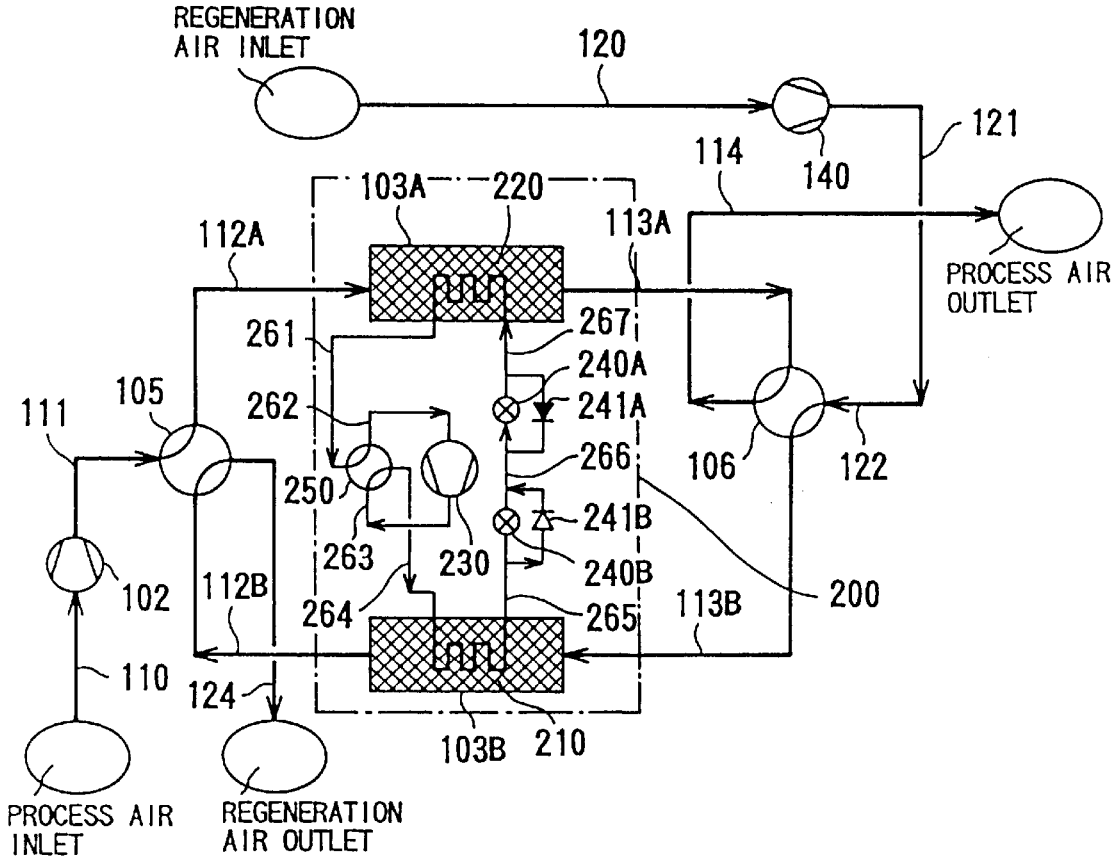
FIG. 6 PRIOR ART
FIG. 6 is a schematic representation of a conventional air conditioning system.
Figure 7:
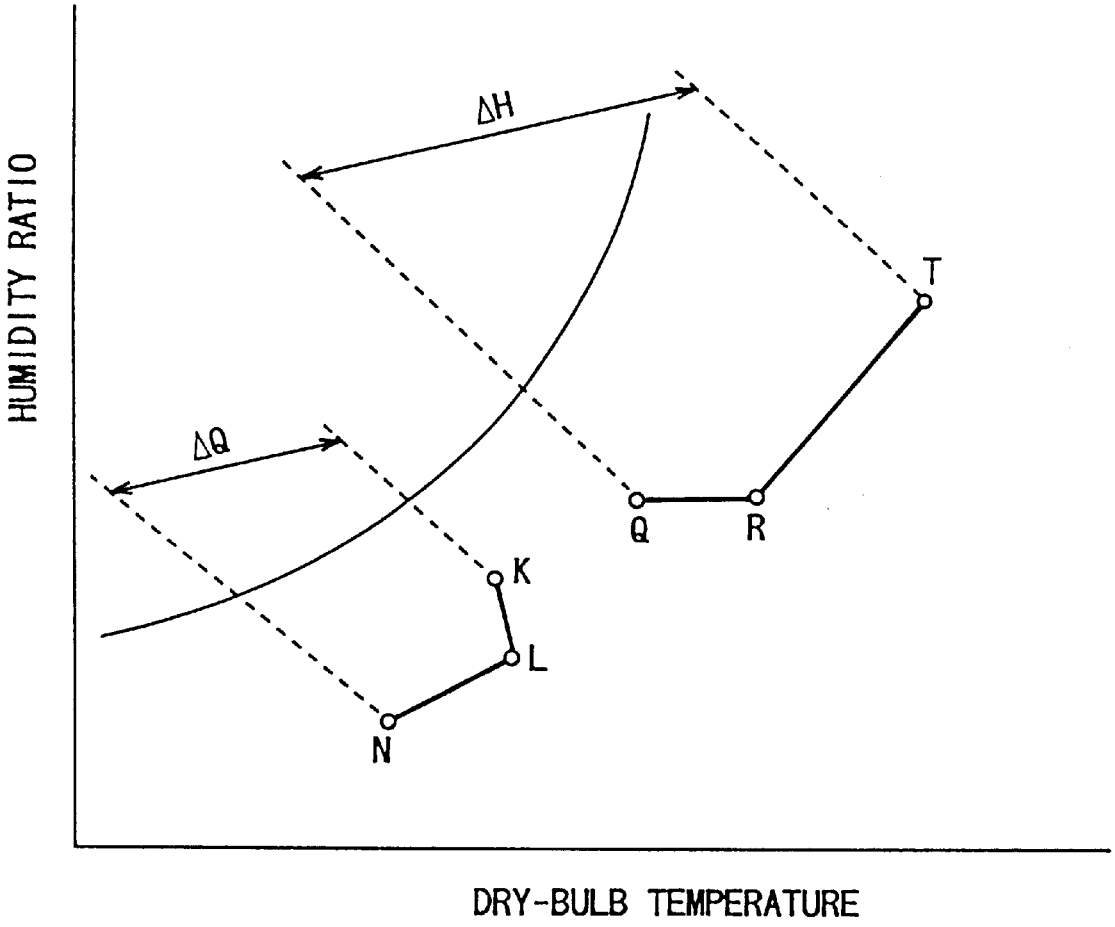
FIG. 7 PRIOR ART
FIG. 7 is a psychrometric chart of the air conditioning cycle in the conventional air conditioning system.

The value of COP to show the energy efficiency as a single unit of the present system is given by dividing the cooling effect ΔQ shown in FIG. 2 by the input regeneration heat ΔH. In the conventional technology shown in FIG. 6, the cooling effect is obtained only from the heat pump action (Δq in FIG. 2) while in the present system, there is a contribution (ΔQ−Δq) from the sensible heat exchanger 104 operating between the process air and the regeneration air. The numerator is increased by this amount and a higher value of energy efficiency is thus achieved.

The value of COP (ΔQ/ΔH) of desiccant assisted cooling system is generally reported in a range of 0.8~1.2 at best. Assuming a value of 1 for COP of the desiccant assisted cooling system, the cooling effect of the air conditioning system is 1. Assuming a value of 1 for the heat input from the compressor, the total available thermal input for operating the present system is 4 which means that the cooling effect of 4 is obtainable from the heating of the regeneration air. In the present system, there is an additional cooling effect of 3 contributed by the low temperature heat source, thus providing a total of 7 for the cooling effect of the present system. The overall system COP is given by:

COP=cooling effect/compressor input=7 and it can be seen that this value is significantly higher than a value of "4 or less" typical of the conventional system.

In the above embodiment, the desiccant beds 103A, 103B are moved by using the motor and the pulley-belt mechanism. However, as long as the desiccant bed 103A, 103B are linearly moved with respect to the casing 302, various mechanism can be employed in the above embodiment, which includes a diaphragm-piston mechanism utilizing a static pressure of the blower for the regeneration air or the process air, a cylinder-piston mechanism utilizing air pressure, an electric rack-and-pinion mechanism, a recirculating ball mechanism using a spiral screw or a link mechanism.

Figure 5:
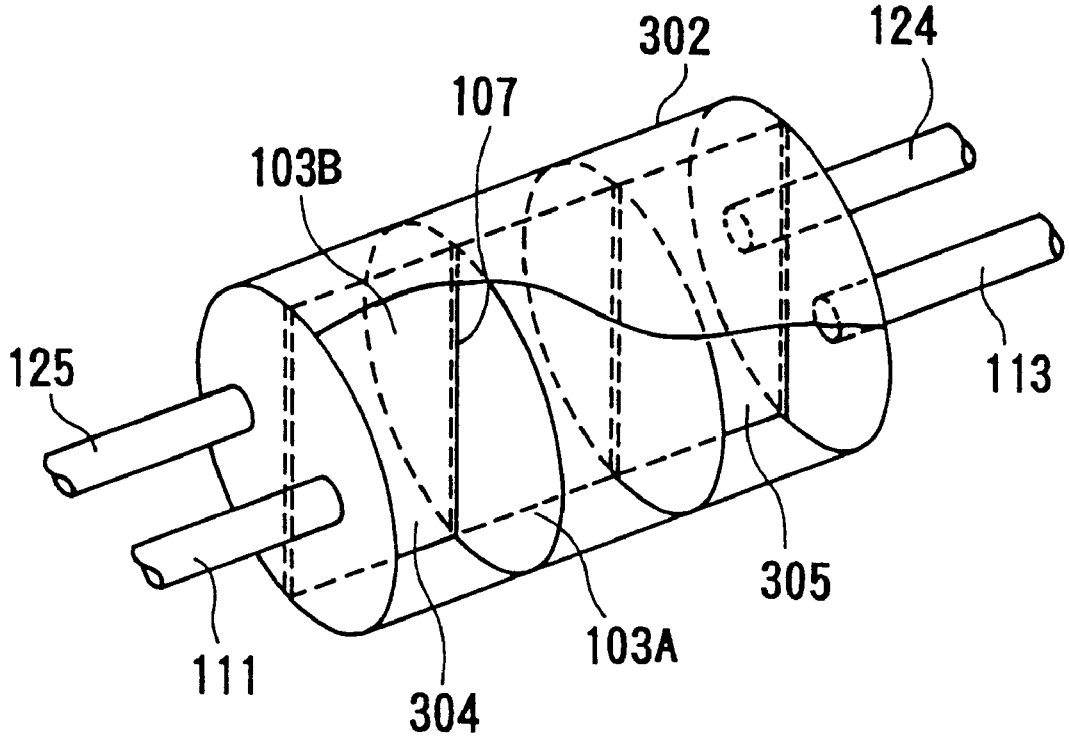
FIG. 5 is a partially perspective view of a second embodiment of the basic configuration of the air conditioning system of the present invention.

FIG. 5 shows a second embodiment of the present invention where switching is embodied by a rotating action to switch the process air passage and the regeneration air passage whereas, in the first embodiment, the desiccant beds are linearly moved with respect to the casing. In the second embodiment of the present invention, two desiccant beds 103A, 103B are joined through a partition wall 107 to form a cylindrical desiccant body. The cylindrical desiccant body is arranged in a cylindrical casing 302 and is rotatable about its own axis therein by a motor (not shown). Inside the casing 302, two hollow spaces are formed at both ends by partition walls 304, 305. One space is connected to the passages 111, 113 for the process air passage A and the other space is connected to the passages 124, 125 for the regeneration air passage B. According to the second embodiment of the present invention, when the water content of one desiccant bed exceeds a predetermined level, the cylindrical desiccant bed is rotated by the motor to switch the process air passage and the regeneration air passage.

In the above embodiments, a vapor compressor type heat pump device was used for the heat pump device 200, however, any type of heat source can be used so long as it provides a heat pump action. For example, an absorption type heat pump disclosed in U.S. Pat. application Ser. No. 08/769,253 can be used to produce the same benefits.

Summarizing the significant features of the present desiccant assisted air conditioning system, two switchable desiccant beds are provided to alternately treat the process air and regeneration air so that moisture in the process air is adsorbed in the one passage while the regeneration air is regenerating the desiccant in the other passage. Since the system does not require four-way valve arrangement, the configuration of the apparatus can be simple. The high temperature heat source of the heat pump device is placed in the regeneration air passage to heat the regeneration air while the low temperature heat source is placed in the process air passage to cool the process air. This arrangement enables to utilize the heat pump device to not only act as a heat source for desiccant regeneration but also to utilize the sensible heat exchanger between the process air and regeneration air to enhance thermal efficiency. The combined effect of this arrangement enables to produce cooling effect in excess of the cooling capacity of the heat pump device, and to achieve a significantly higher energy efficiency in operating the air conditioning system.

Although certain preferred embodiment of the present invention have been shown and described in detail, it should be understood that various changes and modifications may be made therein without departing from the scope of the appended claims.

What is claimed is:

1. A desiccant assisted air conditioning system comprising:

at least two desiccant members;

a process air passage for providing a process air to one of said desiccant members for dehumidification of said process air; and a regeneration air passage for providing a regeneration air to the other of said desiccant members for regeneration of said desiccant members, wherein said desiccant members are linearly movable with respect to said process air passage and said regeneration air passage to alternatingly switch each of said desiccant members from one of said regeneration air passage and said process air passage to another.

2. A desiccant assisted air conditioning system according to claim 1, wherein said two desiccant members are movable together.

3. A desiccant assisted air conditioning system according to claim 1, wherein said two desiccant members are mechanically joined together to form a desiccant unit.

4. A desiccant assisted air conditioning system according to claim 3, wherein said two desiccant members are mechanically joined together through a partition member.

5. A desiccant assisted air conditioning system according to claim 1, wherein said two desiccant members are housed in a casing for defining at least two air passages which are arranged parallel to each other.

6. A desiccant assisted air conditioning system according to claim 5, wherein a shutter member is provided to operatively close a vacant passage within said casing.

7. A desiccant assisted air conditioning system according to claim 1, further comprising a driving device for moving said desiccant members.

8. A desiccant assisted air conditioning system according to claim 1 further comprising:

a heat pump including a high temperature heat source and a low temperature heat source, said high temperature heat source being disposed in said regeneration air passage for heating regeneration air, said low temperature heat source being disposed in said process air passage for cooling of process air; and a sensible heat exchanger for exchanging heat between process air which has passed through said one desiccant member and regeneration air which has not yet entered into said other desiccant member.

9. A desiccant assisted air conditioning system according to claim 8, wherein said heat pump is a vapor compression heat pump.

10. A desiccant assisted air conditioning system according to claim 9, wherein said heat pump is an absorption heat pump.

* * * * *